US005211313A

United States Patent [19]

Lucking et al.

[11] Patent Number: 5,211,313

[45] Date of Patent: May 18, 1993

[54] DISPENSING TAPS

[75] Inventors: Anthony J. Lucking, London; Charles A. Lane, Kingston-on-Thames; Derek L. Tyrrell, Rochford, all of England

[73] Assignee: Waddington & Duval Limited, England

[21] Appl. No.: 712,955

[22] Filed: Jun. 10, 1991

[30] Foreign Application Priority Data

Jun. 20, 1990 [GB] United Kingdom ..... 9013728

[51] Int. Cl.[5] ..... B67B 5/00

[52] U.S. Cl. ..... 222/153; 222/464; 222/546; 222/552; 138/106; 138/110; 138/DIG. 8; 137/170.1; 251/107; 251/215

[58] Field of Search ..... 222/153, 394, 399, 400.7, 222/464, 469, 470, 505, 541, 546, 549, 551, 552, 554, 520; 138/103, 106, 110, DIG. 8; 251/103, 107, 215, 118; 137/170.1, 590

[56] References Cited

U.S. PATENT DOCUMENTS

| | | | |
|---|---|---|---|
| 1,498,953 | 6/1924 | Costello | 222/153 X |
| 2,264,671 | 12/1941 | Kocher | 251/107 X |
| 3,137,326 | 6/1964 | Welty et al. | 137/170.1 X |
| 3,307,751 | 3/1967 | Kraft | 222/464 |
| 3,502,111 | 3/1970 | Hansen | 137/170.1 X |
| 3,784,058 | 1/1974 | Buchtel | 222/464 X |
| 4,414,996 | 11/1983 | Klepa | 222/464 X |
| 4,500,016 | 2/1985 | Funfstuck | 222/520 X |
| 4,708,176 | 11/1987 | Esser | 137/170.1 X |
| 4,836,416 | 6/1989 | Shalgi et al. | 222/520 X |
| 4,895,280 | 1/1990 | Tourigny | 138/110 X |
| 4,976,381 | 12/1990 | Scholle et al. | 222/549 X |
| 5,004,127 | 4/1991 | Morel | 222/505 X |
| 5,050,806 | 9/1991 | Anderson et al. | 222/464 |

*Primary Examiner*—Gregory L. Huson
*Attorney, Agent, or Firm*—Wood, Herron & Evans

[57] ABSTRACT

A dispensing tap of the type which is attached to a cask or a bottle is described. The tap body having an inlet and an outlet and a valve element controlling the outlet. A small bore capillary tube is attached to the inlet of the tap and a sleeve surrounds the junction between the small bore capillary tube and the tap body and pass the length of the small bore capillary tube. The valve element and body are formed with cooperating screw threads so arranged that rotation of the valve element causes movement thereof relative to the outlet to open or close the outlet. A releasable locking means is provided for preventing rotation of the valve element.

15 Claims, 2 Drawing Sheets

48
32
2
50
34
30
36
28
44
10
38
4
26
6
36
24
8
22
27
12
14
20
16
22
58
54
60
56
18
18

DISPENSING TAPS

This invention relates to taps and in particular to dispensing taps for use with pressurised casks and bottles.

Carbonated liquids such as beer, lager and carbonated soft drinks have to be maintained at relatively high pressures both during shipment to the market and in shops and normally also in the period between initial opening of their packaging and final consumption of all the contents thereof, to maintain the carbonation of the liquid at a palatable level. Barrels of lager and beer, as used in public houses etc, are provided with relatively sophisticated tapping devices to reduce the pressure of the liquid from this high level between the container and the tap outlet and thereby ensure that the contents are dispensed satisfactorily without producing an unacceptable amount of froth. With smaller containers it is equally as necessary to reduce the pressure of the liquid before it reaches the outlet to avoid decarbonisation and consequent frothing and unpalatability. One arrangement for achieving this reduction in pressure is to connect a length of small bore tubing to the inlet of the tap. To reach the tap the liquid must pass along the tube which causes its pressure to be reduced to an acceptable, near atmospheric, level when it arrives at the tap outlet.

Generally the tube is allowed to hang free. This is normally the case with containers which are laid on their side on dispensing since the tube dips to the lowest point ensuring that the full contents of the container is dispensed.

In one type of dispensing apparatus, an example of which is described in U.S. Pat. No. 4,739,901, a multi-compartment pouch is provided in the container. The compartments of the pouch are filled with chemicals which produce gas, e.g. carbon dioxide, the arrangement being such that successive compartments are opened and filled with gas, so that they expand, as the liquid contents of the container are dispensed. In other forms of this type of arrangement the pouch is inflated by supply of gas from an external source. In either case, each time a compartment is opened and expanded with gas there is a chance that the bag will thrust against the tube. This can lead to kinking of the tube which results in the flow to the tap not being smooth and dispensing being uneven which is likely to lead to frothing. Moreover if the tube is bent at the point where it is attached to the tap there is a danger that flow along the tube may be blocked or that the tube may be fractured.

One solution which has been suggested to this problem is to fix the tube in a spiral coil around the tap inlet against the mount whereby the tap is connected to the container. This keeps the tube safe and makes the tap easier to handle as the tube does not dangle downwards therefrom. However assembling the tube into the coil and holding it in this position presents difficulties and adds to the cost of the tap. Further the arrangement cannot be used in containers where the free end of the tube needs to be positioned at the lowest point of the container to ensure that all the contents thereof are dispensed.

In a number of known taps the outlet of the tap is controlled by a valve element. The valve element has a bonnet which has screw threads formed on the under surface thereof which cooperate with screw threads on the body of the tap so that rotation of the bonnet causes the valve element to be moved up or down to open or close the outlet of the tap. In most taps the valve stem and the under side of the bonnet are exposed to the pressure of the liquid contents at all times. If there is a rise in pressure, due, for example, to an increase in temperature or agitation of the container, it has been found that there can be a tendency for the screw connection to unwind which results in opening of the tap outlet. This effect which is known as "reverse jacking" is particularly prevalent when the helical screw thread has a large helix angle. Large helix angle threads require less angular rotation to open or close the tap outlet which is popular with the public but are less resistant to pressure thereon than smaller pitch threaded connections. This unwinding and consequent dispensing is obviously undesirable.

A tap for attachment to a cask or bottle in accordance with one aspect of the invention comprises a body having an inlet and an outlet, a valve element for controlling the outlet, an elongate small bore capillary tube connected at one end to the body inlet and a sleeve surrounding the junction between the small bore capillary tube and the body and part of the length of the small bore capillary tube.

With such an arrangement, if the small bore capillary tube is thrust towards the tap body by, for example, distension of an interior bag in the cask or bottle, the sleeve will prevent the tube from bending at the junction thereof with the tap body, where it is most vulnerable, and obviate the danger of breakage in this area. Furthermore the sleeve protects the tube during handling of the tap prior to attachment to a cask or bottle when it is also in danger of being bent round in such a way that kinking or fracture could result.

Preferably the end of the sleeve distant from the junction flares outwards in a large radius curve. This ensures that if the tube is thrust towards the tap body, it is forced against the flared sleeve mouth which, due to the curved shape, causes the tube to take up a curved shape and thus prevents kinking of the tube and consequent uneven flow.

Very suitably the sleeve mouth flares outwards and backwards to form an inverted mushroom shape. With this form, even if the tube is bent right back in itself, no kinking will result. The sleeve edges may also be rounded off so that they will not cause any kinking of the tube.

The tap may include a mount for connecting it to a cask or bottle and the sleeve is suitably carried on that mount.

Preferably, the sleeve includes means for securing the small bore capillary tube thereto adjacent its free end, located such that the free end of the tube will not be obstructed during use of the tap to dispense liquid from a container. The securement means may comprise an aperture in the sleeve wall dimensioned such that the tube end can be passed therethrough. In the embodiment in which the sleeve has a flared mouth, the aperture is suitably provided in the flared portion. By securing the tube free end it is prevented from being forced against a wall of a container with which the tap is used which would stop liquid flow therealong. Furthermore when the container is of the type which contains an expandable pouch, the tube end can be secured in a position in which it will not become blocked by the pouch as that expands, in particular, in the embodiment where the sleeve mouth is flared the tube end can be positioned on the opposite side of the flared mouth from the expandable pouch.

A tap for attachment to a pressurised cask or bottle in accordance with another aspect of the invention comprises a body having an outlet and a valve element to control the outlet, the valve element and body being formed with cooperating screw threads so arranged that rotation of the valve element causes movement thereof relative to the outlet to open or close the outlet, and, releasable locking means for preventing rotation of the valve element.

The provision of locking means for the tap, arranged to prevent rotation of the valve element relative to the body of the tap, enables the valve element to be secured in a closed position in which it will remain even when there is a pressure rise in the cask or bottle to which the tap is attached due to, for example, a temperature rise or agitation.

Preferably the locking means, when released, forms a handle for the valve element whereby it may be rotated. The locking means may be in the form of an elongate element and this is much easier to grasp and turn than the bonnets normally provided. Thus the tap is convenient and easy to operate.

Preferably indicia means are provided which show that the locking means has been released. This allows both the distributers of the cask or bottle and the ultimate purchaser to be able to recognise whether there has been tampering with the cask or bottle and gives the ultimate customer the assurance that none of the contents have previously been removed or adulterated during distribution.

Suitably the locking means is so arranged that it is automatically released when the pressure in a cask or bottle to which the tap is attached is at a certain pre-set maximum level. This provides a safety feature in that if the pressure rises above a safe level the locking means will automatically be released so that the valve element can open and allow release of the pressure which obviates the danger of explosion.

A preferred form for the locking means is an elongate element one end of which is fixedly secured, by a hinge connection, to one of the valve element and the body and the other end of which is releasably secured to the other of the valve element and the body. The provision of a hinged connection between the locking means and the part to which it is fixedly connected allows an arrangement whereby the locking means is, in its locked position, closely adjacent the tap body which makes the tap compact and easy to handle and reduces the chances of snagging and undesired release of the locking means. In its released position, the locking element extends outwardly from the tap where it can be grasped to turn the valve element.

The invention will now be further described by way of example with reference to the accompanying drawings in which.

Figure 1:
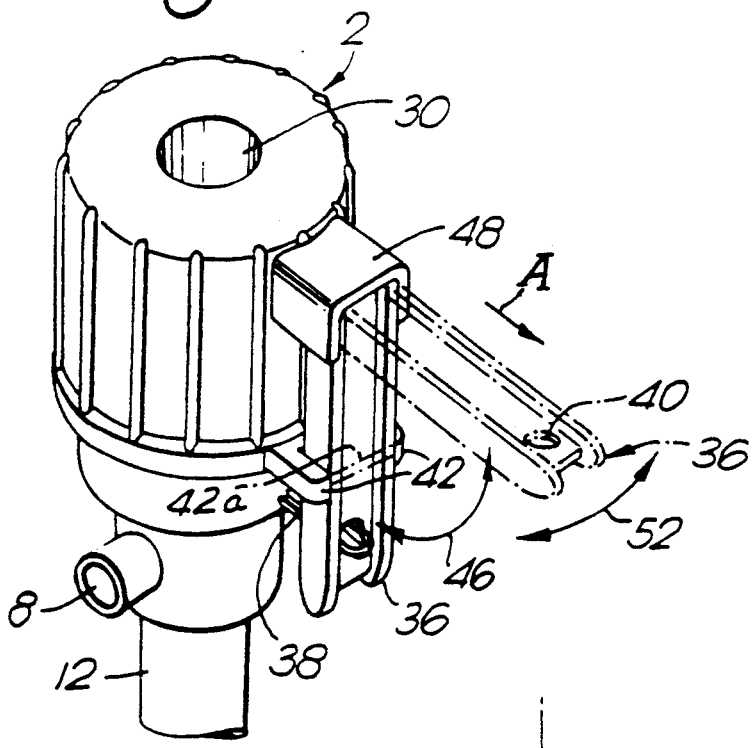
FIG. 1 is a perspective view of part of a first embodiment of a tap in accordance with one aspect of the invention.

The tap 2 shown in the Figures has a body formed from a plastic material, for example, polypropylene or high density polyethylene comprising a body 4 consisting of a valve chamber 6 having an outlet 8, a valve element 10 being moveable within the valve chamber 6 to open and close the outlet 8. The valve element 10 is shown on the left-hand side of FIGS. 2 and 3 in its closed position and on the right-hand side thereof in its open position.

The liquid flow path through the tap 2 to the valve chamber 6 and the outlet 8 is defined by a cylindrical chamber 12, one end of which opens into the valve chamber 6. At the other end of the cylindrical chamber 12 it is attached to an expansion chamber 14. The cross-sectional area of the expansion chamber 14 is a maximum at this point and is equal to the cross-sectional area of the cylindrical chamber 12. The expansion chamber 14 converges continuously, from its point of connection to the cylindrical chamber 12, to a minimum at an angle of about 10° to 20° and then extends at a constant diameter to form a tube 16.

A small bore capillary tube 18 is attached to the tap body 4 by way of the tubular extension 16 of the expansion chamber 14. The diameter of the bore of the tube 18 is equal to that of the bore of tubular extension 16. As shown in the Figures, the small bore capillary tube 18 may be attached to the exterior of the tubular extension 16 which is then shaped so that the end of the small bore capillary tube 18 can be pushed thereover without altering the diameter of the bore of the tube 18 at the point where liquid will pass from this to the tubular extension 16. In an alternative arrangement the end of a small bore 18 is attached internally to the tubular extension 16, in which case the internal bore of the tubular extension 16 will be arranged so the end of the small bore capillary tube 18 can be received therein without producing any change in diameter of the liquid flow path from the small bore capillary tube 18 to the bore of the tubular extension 16, i.e., the bore of the tubular extension 16 will be suitably reamed out.

Thus, a smooth flow path is provided between the free end of the small bore capillary tube 18 and the outlet 8 of the tap. In particular there are no sudden divergencies or convergencies in the path between the free end of the small bore capillary tube 18 and the outlet end of the cylindrical chamber 12. The internal surface finish of the capillary tube 18, expansion chamber 14 and tubular extension 16 thereof, the cylindrical chamber 12 and the valve chamber 6 is carefully controlled to reduce as far as possible any discontinuities or sharp edges in the surface thereof. Furthermore, there are no obstructions in the flow path from the end of the small bore tube 18 to the outlet 8 of the tap 2, when the valve element 10 is in the open position, which is in contrast to some known dispensing arrangements where springs or other parts intrude into the liquid flow path. By reducing to a minimum the discontinuities, that is, sharp edges, sudden divergencies etc., and providing no obstructions in the flow path the amount of possible nucleations size for gas bubbles is minimized with a consequence minimization of the possibility of decarbonation of liquid flowing along the liquid flow path which would cause frothing on dispensing.

The capillary tube 18 and expansion chamber 14 serve to reduce the pressure on liquid passing therealong from the relatively high value prevalent in the majority of containers for carbonated beverages to a value at which the velocity of liquid dispensed will be sufficiently low that there will not be an undue amount of froth produced on dispensing.

Figure 2:
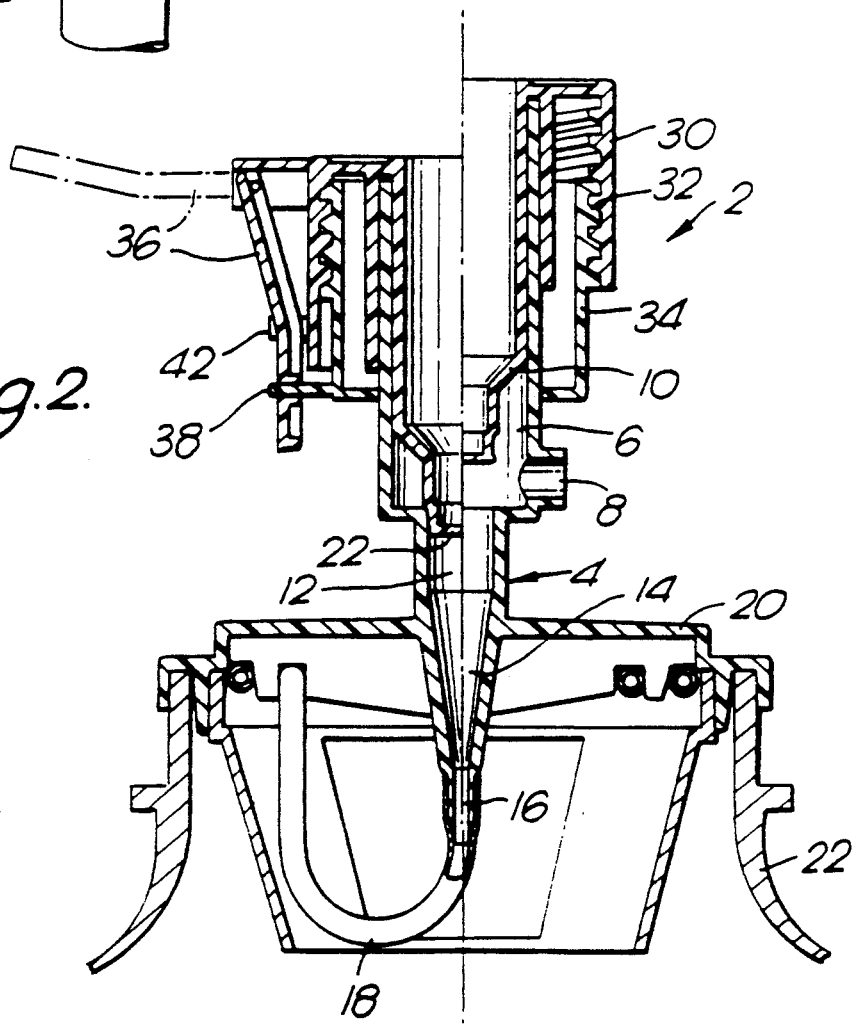
FIG. 2 is a vertical section through the complete tap of FIG. 1 and illustrates the open and closed positions of that tap, and, FIG. 3 is a vertical section through a second embodiment of a tap in accordance with the invention which illustrates the open and closed positions of that tap.
Figure 3:
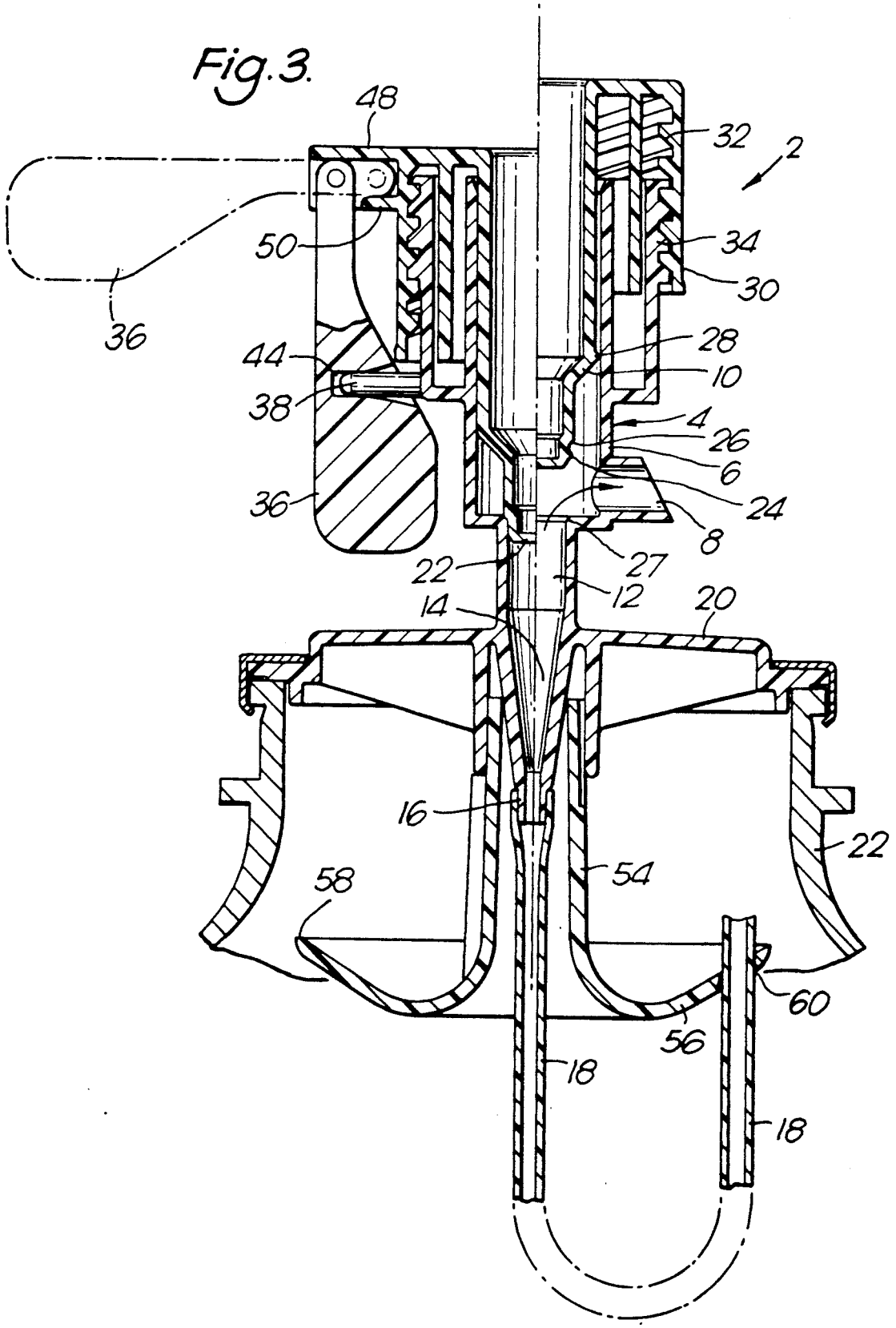

The tap body 4 extends in a skirt around the expansion chamber 14 to form a mount 20 whereby it may be connected to a cask or bottle, part of which 22 is shown in FIGS. 2 and 3.

The valve element 10 comprises a valve stem, the lower end 22 of which is shaped to form a double seal with valve body 4 when in the closed position shown on the left-hand side of FIGS. 2 and 3. The two seals are formed respectively between (i) a bead 24 on the extreme portion of the lower end 22 of the valve stem which engages the wall of the chamber 12 and (ii) a conical seat 26 on the lower end 22 of the valve stem which engages a corresponding seat 27 on the shoulder between the chamber 12 and the valve chamber 6. Liquid is prevented from entering the portion of the valve chamber 6 on the other side of the outlet 8 by a running seal consisting of a bead 28 on the valve stem.

At its upper end the valve stem is provided with bonnet 30. The bonnet 30 can rotate relative to the tap body 4, to raise or lower the valve element 10 to open or close the outlet 8, by virtue of inter-engaging threads 32 formed on the bonnet 30 and an extension of the tap body 34.

If the pressure rises unexpectedly in a container to which a tap 2 is attached, due, for example, to agitation of the contents of the container, that pressure can reach a level which would cause unscrewing of the connection between the bonnet 30 and the tap body 4, which phenomena is known as "reverse jacking". This will lead to the outlet 8 of the tap 2 being opened unexpectedly.

In order to prevent this locking means in the form of an elongate element 36 is provided. The locking element 36 is mounted at one end thereof to the bonnet 30, the mount being in form of a hinge which allows the locking element 36 to be rotated between two positions shown respectively in full and in dotted outline in the Figures. In the first position, shown in the full outline, the locking element 36 is held against the bonnet 30 by retaining means. In the arrangement shown in FIGS. 1 and 2 the retaining means comprises a pin 38 on the bonnet 30 which passes through an aperture 40 in the free end of the locking element 36. The locking element 36 is additionally held by a fork 42 also formed on the bonnet 30.

In the second embodiment shown in FIG. 3 the locking element 36 is held in position by retention means which again comprises a pin 38, the pin 38 in this case being received within a recess 44 in the locking element 36.

In either embodiment with the locking element 36 held in the first, full outline, position by the retention means, rotation of the bonnet 30 relative the tap body 4 is prevented and thus so too is any movement of the valve element 10 relative to the tap body 4 so that no "reverse jacking" will occur.

When the valve element 10 is to be moved, the locking element 36 is released from the retention means by pulling it away from the bonnet 30. The connection between the locking element 36 and the bonnet 30 is such that the locking element 36 can then be swung upwards, see the arrow 46, into the second, dotted outline, position in which it extends out from the bonnet 30. The hinged connection between the locking element 36 and the bonnet 30 which allows the former to move between the two positions is formed between a U-shaped extension 48 of the bonnet 30 and the locking element 36, the dimensions of the parts 36, 48 being such that the end of locking element 36 is captive in extension 48 but can rotate relative thereto. Once in the second position the locking element 36 can be pushed towards the bonnet, see arrow A, into the bonnet extension 48 so that its connected end is held between the extension 48 and ledge 50 which protrudes from the bonnet 30 below the extension 48. The ledge 50 then serves to prevent the locking element 36 from being rotated downwards, i.e., it holds it in a position extending transversely out from the bonnet 30. The locking element 36 can then be manually grasped and employed to turn the bonnet 30 and hence raise or lower the valve element 10, see arrow 52. The locking element 36 is easy to grasp and provides greater purchase than the bonnet 30. It thus facilitates operation of the tap 2.

It will be noted that in its first, retained, position the locking element 36 is held closely adjacent to the tap body 4. Thus there is little risk of it being snagged or of inadvertent release of the locking element 36.

Indicia means to show that the tap 2 has been tampered with can be provided. This can be added when the tap has been fitted to a cask or bottle prior to its dispatch in such a way that it is broken on first release of the locking means to open the tap 2. The ultimate customer then has the security of knowing that the contents of the cask or bottle have not been tampered with and that none has been withdrawn. Indicia means may suitably be provided by attaching a thin strip 42*a* of plastic between the ends of the forks 42 of the first embodiment shown in FIGS. 1 and 2 once the locking element 36 has been placed in its retained position therebetween. The first time that the locking element 36 is released it will break the strip of plastic.

The retention means for securing the locking element 36 in the locked position relative to the bonnet 30 may be so arranged that, if the pressure in the cask or bottle to which the tap 2 is attached, rises to a dangerous level the force trying to rotate the bonnet 30 to open the outlet 8 is such as to break the retention means. Thus the locking element 36 will automatically be released if the pressure rises to previous level and the tap 2 will automatically open to release the pressure and therefore obviate the danger of explosion.

In the embodiment illustrated in FIG. 2 the small bore tube 18 is curled up into the tap mount 20. This serves to protect the tube 18 and makes the tap 2 easy to handle since the tube 18 is safely tucked away. However this arrangement is somewhat complicated and increases the cost of production of the tap.

Moreover this arrangement is only suitable when the cask or bottle is such that all the liquid content therein would driven towards the tap by the pressure thereon. When this is not the case, and particularly when the cask or bottle is to be used on its side, the small bore tube 18 needs to be left to hang free so that its extreme end will come to lie in the lowermost point of the cask or bottle to ensure that all the liquid contents thereof are available for dispensing.

When the small bore tube 18 is not curled away, there is a danger that a mechanical thrust thereon will force it against the tap body 4 causing it to kink and, in extreme cases, bend at the junction with the expansion chamber 14 resulting in fracture at this point.

To prevent this, in the embodiment shown in FIG. 3 the tap 2 is provided with a sleeve 54 which extends across the junction between the expansion chamber 14 and the small bore tube 18 and across the connected end portion of the small bore tube 18. The mouth 56 of the sleeve 54 flares outwards and backwards to give the sleeve an overall inverted mushroom shape.

If there is a sudden rise of pressure within a container with which the tap 2 is used which thrusts the small bore tube 18 towards the tap body 4, the sleeve 54 will prevent any bending of the tube at the junction thereof with the expansion chamber 14. The sleeve 54 will thus obviate any danger of kinking or fracture of the small bore tube 18 at this point. The flared mouth 56 of the sleeve 54 will cause the small bore capillary tube 18 to take up a smoothly curved orientation if subjected to any thrust and will thus prevent any kinking of the tube 18 which could produce frothing or prevent any flow whatsoever therealong.

The extreme edges 58 of the flared mouth 56 are also smoothly curved to ensure that, if the tube 18 wraps around them, they will not cause it to bend sharply.

The sleeve 54 is carried by an extension of the mount 20.

The flared mouth 56 of the sleeve 54 may be provided with an aperture 60 dimensioned to receive the small bore capillary tube 18 therein in a close fit. By passing the free end of the small bore capillary tube 18 through the aperture 60 this is held in place and in particular is prevented from being thrust against a wall of the container or an expandable bag, if the container is of the type in which such a bag is employed. Thus there will be no danger of the end of the tube becoming blocked and liquid being prevented from flowing to the main tap body 4. With the form of tap shown in FIG. 3 the free end of the tube 18 is located in a space defined between the sleeve 54 and container wall, see 22, and the flared mouth 56 thus separates it from an expandable bag if one is employed. A further advantage of fixing the free end of the capillary tube 18 is that the tap 2 is then easier to handle as the full length of the tube is not dangling freely down therefrom.

We claim:

1. A tap for attachment to a cask or bottle comprising:

a body having an inlet and an outlet;

a valve element for controlling fluid flow from the inlet to the outlet;

an elongate small bore capillary tube having a first and a second end, the first end being connected to the body inlet;

a sleeve having a first end and a second end, the first end of the sleeve surrounding the first end of the capillary tube and the body inlet, the second end of the sleeve having a sleeve mouth flaring outwardly and backwardly so that the capillary tube does not kink against the sleeve; and an aperture in the sleeve to receive the second end of the capillary tube in a close fit.

2. A tap for attachment to a cask or bottle comprising a body having an inlet and an outlet, a valve element for controlling fluid flow from the inlet to the outlet, an elongate small bore capillary tube having a first and a second end, the first connected at one end thereof being connected to the body inlet, and a sleeve having a first end and a second end, the first end of the sleeve surrounding the junction between the small bore capillary tube and the body and part of the length of the small bore capillary tube first end of the capillary tube and the body inlet, the second end of the sleeve having a sleeve mouth flaring outwardly and backwardly so that the capillary tube does not kink against the sleeve.

3. A tap as claimed in claim 2, the sleeve mouth including smoothly curved edges.

4. A tap as claimed in claim 2 wherein a mount is provided for connecting the tap to the cask or bottle, the sleeve being carried on the mount.

5. A tap as claimed in claim 2, the sleeve including means for securing the second end of the small bore capillary tube to the sleeve.

6. A tap as claimed in claim 5, the securing means including an aperture in the sleeve to receive the second end of the capillary tube in a close fit.

7. A tap as claimed in claim 2, the body including a valve chamber joined to the body outlet, a feed chamber joined to the valve chamber, an expansion chamber coaxially aligned with and joined to the feed chamber, the small bore capillary tube being joined to the expansion chamber, the feed chamber, the expansion chamber, and the small bore tube being joined such that a flow path is provided with substantially no discontinuities whereby frothing is substantially reducing during dispensing from the tap.

8. A tap as claimed in claim 1, the valve element being formed with screw threads and the body being formed with screw threads, the screw threads of the body cooperating with the screw threads of the valve element so that rotation of the screw threads formed in the valve element relative to the screw threads of the body opens and closes the outlet, and releasable locking means for preventing rotation of the screw threads in the valve element relative to the screw threads in the body.

9. A tap as claimed in claim 8, the releasable locking means further including indicia means to indicate that the locking means has been released.

10. A tap as claimed in claim 8 wherein the releasable locking means comprises an elongate element having two ends, one end of the elongate element is pivotably secured to one of the valve element and the body and the other end of the elongate element is releasably secured to the other of the valve element and the body.

11. A tap as claimed in claim 10, the releasable locking means further including a hinge for pivotably securing the one end of the elongate element to the one end of the valve element and the body.

12. A tap as claimed in claim 10, the releasable locking means further including a pin mounted to one of the elongate element and the other of the valve element and the body, and an aperture within the other of the elongate element and the other of the valve element and the body, the aperture being dimensioned to receive the pin whereby the screw threads of the valve element and body may not be moved relative to one another.

13. A tap as claimed in claim 8, the valve element further includes a valve stem having first and second ends, the first end of the valve stem cooperates with the body to control fluid flow from the inlet to the outlet and the second end of the valve stem carries a bonnet, the screw threads of the valve element being provided on the bonnet.

14. A tap as claimed in claim 8, the body further including a valve chamber having the outlet at one end, a feed chamber joined to the valve chamber, an expansion chamber coaxially aligned with and joined to the feed chamber, a small bore capillary tube being joined to the expansion chamber, the feed chamber, the expansion chamber and the small bore tube being joined such that a flow path having substantially no discontinuities is provided from the small bore tube to the outlet whereby frothing is substantially reduced during dispensing from the tap.

15. A tap as claimed in claim 8, the releasable locking means further including a handle for selectively rotating the screw threads of the valve element relative to the screw threads of the body.

* * * * *